United States Patent [19]

Horodysky et al.

[11] Patent Number: 4,816,037

[45] Date of Patent: Mar. 28, 1989

[54] LONG CHAIN DIOLS AND LUBRICANTS CONTAINING SAME

[75] Inventors: Andrew G. Horodysky, Cherry Hill; Joan M. Kaminski, Mullica Hill, both of N.J.

[73] Assignee: Mobil Oil Corporation, New York, N.Y.

[21] Appl. No.: 105,993

[22] Filed: Oct. 5, 1987

Related U.S. Application Data

[63] Continuation of Ser. No. 935,610, Dec. 1, 1986, abandoned, which is a continuation of Ser. No. 831,072, Feb. 18, 1986, abandoned, which is a continuation of Ser. No. 536,801, Sep. 28, 1983, abandoned.

[51] Int. Cl.[4] ..... C10L 1/22

[52] U.S. Cl. ..... 44/53; 44/56; 44/57; 44/72

[58] Field of Search ..... 44/53, 56, 57, 72

[56] References Cited

U.S. PATENT DOCUMENTS

| | | | |
|---|---|---|---|
| 1,989,528 | 1/1935 | Rather et al. | 44/72 |
| 2,305,673 | 12/1942 | Chenicek | 44/72 |
| 2,305,674 | 12/1942 | Chenicek | 44/72 |
| 2,695,222 | 11/1954 | Chenicek et al. | 44/72 |
| 3,115,400 | 12/1963 | Marsh et al. | 44/72 |
| 3,372,009 | 3/1968 | Waldmann | 44/72 |
| 4,391,610 | 7/1983 | Sung et al. | 44/72 |
| 4,409,000 | 10/1983 | Le Suer | 44/72 |

*Primary Examiner*—William R. Dixon, Jr.
*Assistant Examiner*—Jerry D. Johnson
*Attorney, Agent, or Firm*—Alexander J. McKillop; Charles J. Speciale; Van D. Harrison, Jr.

[57] ABSTRACT

Polyhydroxy-containing hydrocarbylamines, when added to a lubricant or to a liquid fuel, reduce friction between surfaces of metal in contact. They also can reduce fuel consumption in an internal combustion engine.

12 Claims, No Drawings

LONG CHAIN DIOLS AND LUBRICANTS CONTAINING SAME

This is a continuation of copending application Ser. No. 935,610, abandoned filed on Dec. 1, 1986, which is a continuation of Ser. No. 831,072, abandoned filed Feb. 18, 1986, which is a continuation of Ser. No. 536,801, abandoned filed Sept. 28, 1983.

BACKGROUND OF THE INVENTION

1. Field of the Invention

The invention relates to lubricant and liquid fuel compositions. In particular, it relates to the use of polyhydroxy-containing hydrocarbylamines in lubricants and liquid fuels to reduce friction and fuel consumption in internal combustion engines.

2. Discussion of the Prior Art

It is known that sliding or rubbing metal or other solid surfaces are subject to wear under conditions of extreme pressure. Wearing is particularly acute in modern engines in which high temperatures and contact pressures are prevalent. Under such conditions, severe erosion of metal surfaces can take place even with present generation lubricants unless a load carrying or antiwear additive is present herein.

Friction is also a problem any time two surfaces are in sliding or rubbing contact. It is of especial significance in an internal combustion engine and related power train components, because loss of a substantial amount of the theoretical mileage possible from a gallon of fuel is traceable directly to friction.

With respect to the compositions of this invention, no art is known that teaches or suggests them. However, certain amines are well known for their use in lubricants. For example, N-phenyl-alpha naphthylamine has been used alone and in combination with other materials as an antioxidant.

SUMMARY OF THE INVENTION

In accordance with the present invention there is provided a lubricant or liquid fuel composition comprising a major portion of a fuel or lubricant and a friction reducing amount of a polyhydroxyl hydrocarbylamine containing a total of 12 to 66 carbon atoms. In such compositions, the product can be used in friction reducing amounts, which can range from about 0.1% by weight to about 2.0% by weight in lubricants. "Hydrocarbyl" includes alkyl or alkenyl.

BACKGROUND OF THE INVENTION

The polyhydroxy hydrocarbylamines contemplated for use in this invention are those having the formula:

$$(HO)_xRN(R^1)_2$$

wherein R is a $C_2$ to $C_6$ alkyl or alkenyl, $R^1$ is hydrogen or a $C_{10}$ to $C_{30}$ alkyl or alkenyl group, at least one of which is the latter, and x is 2 or 3. Rand $R^1$ may be linear or branched, saturated or unsaturated. The hydroxyl groups may be located anywhere along the chain, i.e., they may be separated by any number of carbons in the chain or they may be on adjacent carbons. Although the location of the hydroxy group is not critical, optimal performance is exhibited when they are vicinal and near or at the end of the chain.

The useful amines can be synthesized using several methods known to the art. For example, an alkylamine-1,2-propanediol, represented as

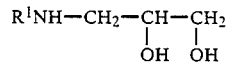

can be prepared by the reaction of the appropriate alkylamine or sodium alkylamide with 1-chloro-2,3-propanediol, or more preferably by the reaction of the alkylamine with glycidol at room temperature, to wit:

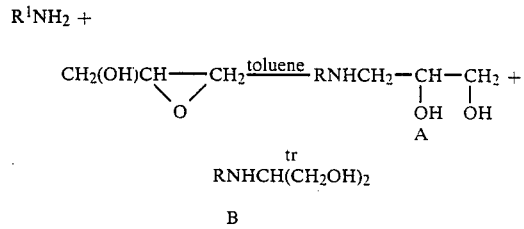

As disclosed hereinabove, the polyhydroxyamines are used in lubricating oils to the extent of from about 0.1% to about 2% by weight of the total composition and in fuels in an amount of from about 0.0001% by weight to about 0.2% by weight. Furthermore, other additives, such as detergents, antioxidants, antiwear agents and the like may be present. These include phenates, sulfonates, succinimides, zinc dithiophosphates, polymers and the like.

The amines of the invention are especially effective in synthetic oils formulated using mixtures of synthetic hydrocarbon olefin oligomers and lesser amounts of hydrocarbyl carboxylate ester fluids.

In general, the lubricants contemplated for use with the esters herein disclosed include mineral and synthetic hydrocarbon oils of lubricating viscosity, mixtures of mineral oils and synthetic oils and greases from any of these. The synthetic hydrocarbon oils include long chain alkanes such as cetanes and olefin polymers such as oligomers of hexane, octene, decene, and dodecene, etc. The other synthetic oils, which can be used alone with the compounds of this invention, or which can be mixed with a mineral and synthetic hydrocarbon oil, or mixtures thereof, include (1) fully esterified ester oils, with no free hydroxyls, such as pentaerythritol esters of monocarboxylic acids having 2 to 20 carbon atoms, trimethylolpropane esters of monocarboxylic acids having 2 to 20 carbon atoms, (2) polyacetals and (3) siloxane fluids. Especially useful among the synthetic esters are those made from polycarboxylic acids and monohydric alcohols. More preferred are the ester fluids made by fully esterifying pentaerythritol, or mixtures thereof with di- and tripentaerythritol, with an aliphatic monocarboxylic acid containing from 1 to 20 carbon atoms, or mixtures of such acids.

The liquid fuels contemplated include liquid hydrocarbon fuels such as fuel oils, diesel oils and gasolines and alcohol fuels such as methanol and ethanol.

Alkyl amines which can be used to prepare polyhydroxy hydrocarbylamines include cocoamine, oleylamine octadecylamine, soyamine, decylamine, dodecylamine, tetradecylamine, stearlyamine, tallowamine, and mixtures of above or similar amines. Also included are the t-alkylamines in the $C_{12}$ to $C_{14}$ carbon range having the following grouping

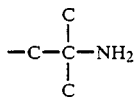

as exemplified by the commercially available Primene 81R from Rohm and Hass. Further contemplated are the higher molecular weight Primene JM-T. Preferred, however, are linear or only slightly branched amines.

Having described the invention in general terms, the following are offered to specifically illustrate the development. It is to be understood they are illustrations only and that the invention shall not be limited except by the appended claims.

EXAMPLE 1

1,2-Dihydroxypropane Cocoamine

Approximately 1050 g of cocoamine and about 1.3 liters of toluene were charged to a 5 liter glass reactor. Over a 3 hour period, 370 g of glycidol were slowly added in small increments with agitation. The reaction was exothermic, reaching 90° C. at the end of the glycidol addition. The reactor contents were then heated at 105° C. for about 4½ additional hours. The solvent was removed by vacuum distillation leaving an amber fluid product which formed a white waxy solid upon cooling.

EXAMPLE 2

1,2-Dihydroxypropane Cocoamine

Approximately 10 g of cocoamine and 0.2 liters of toluene were charged to a glass reactor. Over a 3 hour period of time, 37 g of glycidol were slowly added in small increments with agitation. The reaction was exothermic and the reaction temperature was held within a range of 22° to 31° C. for 2 additional hours. By infrared absorption spectroscopy analysis, it was found that both $—NH_2$ and epoxide groups had disappeared and large hydroxyl adsorption bands appeared. The solvent was removed by vacuum distillation. The product formed a white, waxy solid upon cooling.

EXAMPLE 3

1,2-Dihydroxypropane Octadecylamine

Approximately 280 g of octadecylamine and about 0.35 liter of toluene were charged to a glass reactor and warmed to about 60° C. Over a 3 hour period of time, 38 g of glycidol were slowly added in small increments with agitation while maintaining a temperature of 60° to 65° C. The reactor contents were then heated at about 90° C. for 26 additional hours. The solvent was removed by vacuum distillation and the resulting product formed a pale yellow waxy solid after cooling.

EVALUATION OF PRODUCTS

The compounds were evaluated as friction modifiers in accordance with the following test.

LOW VELOCITY FRICTION APPARATUS

Description

The Low Velocity Friction Apparatus (LVFA) is used to measure the friction of test lubricants under various loads, temperatures, and sliding speeds. The LVFA consists of a flat SAE 1020 steel surface (diam. 1.5 in.) which is attached to a drive shaft and rotated over a stationary, raised, narrow ringed SAE 1020 steel surface (area 0.08 in.$^2$). Both surfaces are submerged in the test lubricant. Friction between the steel surfaces is measured as a function of the sliding speed at a lubricant temperature of 250° F. The friction between the rubbing surfaces is measured using a torque arm-strain gauge system. The strain gauge output, which is calibrated to be equal to the coefficient of friction, is fed to the Y axis of an X-Y plotter. The speed signal from the tachometer-generator is fed to the X-axis. To minimize external friction, the piston is supported by an air bearing. The normal force loading the rubbing surfaces is regulated by air pressure on the bottom of the piston. The drive system consists of an infinitely variable-speed hydraulic transmission driven by a ½ HP electric motor. To vary the sliding speed, the output speed of the transmission is regulated by a lever-cam motor arrangement.

Procedure

The rubbing surfaces and 12 ml of test lubricant are placed on the LVFA. A 240 psi load is applied and the sliding speed is maintained at 40 fpm at ambient temperature for a few minutes. A plot of coefficients of friction ($U_k$) over the range of sliding speeds, 5 to 40 fpm (25–195 rpm), is obtained. A minimum of three measurements is obtained for each test lubricant. Then, the test lubricant and specimens are heated to A250° F., another set of measurements is obtained, and the system is run for 50 minutes at 250° F., 240 psi and 40 fpm sliding speed. Afterward, measurements of $U_k$ vs. speed are taken at 240, 300, 400, and 500 psi. Freshly polished steel specimens are used for elach run. The surface of the steel is parallel ground to 4–8 microinches.

The data obtained are shown in Table 1. The data in Table 1 are reported as percent reduction in coefficient of friction at two speeds. The friction-reducing ester additives were evaluated in a fully formulated SAE 5W-30 lubricating oil comprising an additive package including antioxidant, detergent and dispersant. The oil had the following general characteristics:

Viscosity 100° C.—11.0cs
Viscosity 40° C.—58.2cs
Viscosity Index—172

TABLE 1

| | Frictional Properties | | |
|---|---|---|---|
| | Additive | Reduction in Coefficient of Friction % Change | |
| | Conc. Wt. % | 5 Ft./Min. | 30 Ft./Min. |
| Base Oil | — | 0 | 0 |
| Example 1 | 1 | 31 | 37 |
| Example 2 | ½ | 21 | 22 |
| Example 3 | ½ | 27 | 31 |

The results clearly show the hydrocarbyl polyhydroxyamine to be a superior friction reducer. The use of ½% of the products of Examples 1 and 2 reduced the coefficient of friction by up to 31%.

We claim:

1. A fuel composition comprising a major amount of a fuel selected from the group consisting of liquid alcohol and gasoline and an antifriction amount of a polyhydroxy alkyl amine or alkenyl amine containing a total of from 12 to 66 carbon atoms and containing two OH groups vicinal to each other said amine having the structural formula $$(HO)_xRN(R^1)_2$$

wherein R is a $C_2$ to $C_6$ alkyl or alkenyl group, $R^1$ is hydrogen or a $C_{10}$ to $C_{30}$ alkyl or alkenyl group, at least one of $R^1$ being an alkyl or alkenyl group and x is 2 or 3.

2. The composition of claim 1 wherein the amine is derived from decylamine, dodecylamine, tetradecylamine, octadecylamine, oleylamine, soyamine, tallowamine, and mixture of such amines and contains two OH groups vicinal to each other.

3. The composition of claim 1 wherein the amine is 1,2-dehydroxypropane cocoamine.

4. The composition of claim 1 wherein the amine is 1,2-dehydroxypropane octadecylamine.

5. The composition of claim 1 wherein the fuel is a liquid alcohol.

6. A method of reducing fuel consumption in an internal combustion engine by fueling said engine with a composition comprising a major proportion of a liquid fuel selected from the group consisting of liquid alcohol and gasoline, and a fuel consumption reducing amount of an amine of the formula:

$$(HO)_xRN(R^1)_2$$

wherein R is a $C_2$ to $C_6$ alkyl or alkenyl group, $R^1$ is hydrogen or a $C_{10}$ to $C_{30}$ alkyl or alkenyl group, at least one of $R^1$ being an alkyl or alkenyl group and x is 2 or 3.

7. The method of claim 6 wherein the amine is derived from decylamine, dodecylamine, tetradecylamine, octadecylamine, oleylamine, soyamine, tallowamine, and mixture of such amines and contains two OH groups vicinal to each other.

8. The method of claim 6 wherein the amine is 1,2-dihydroxypropane octadecylamine.

9. The method of claim 6 wherein the amine is 1,2-dihydroxypropane cocoamine.

10. The method of claim 6 wherein the fuel is a liquid alcohol.

11. The composition of claim 1 wherein the liquid fuel is gasoline.

12. The method of claim 6 wherein the liquid fuel is gasoline.

* * * * *